US008231195B2

(12) United States Patent
Kubo et al.

(10) Patent No.: US 8,231,195 B2
(45) Date of Patent: Jul. 31, 2012

(54) PRINT ELEMENT SUBSTRATE, PRINTHEAD, AND PRINTING APPARATUS

(75) Inventors: Kousuke Kubo, Yokohama (JP); Yoshiyuki Imanaka, Kawasaki (JP); Koichi Omata, Kawasaki (JP); Souta Takeuchi, Yokohama (JP); Takaaki Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 406 days.

(21) Appl. No.: 12/428,979

(22) Filed: Apr. 23, 2009

(65) Prior Publication Data

US 2009/0278878 A1 Nov. 12, 2009

(30) Foreign Application Priority Data

May 8, 2008 (JP) ..... 2008-122774

(51) Int. Cl.

| | |
|---|---|
| ***B41J 29/38*** | (2006.01) |
| ***B41J 2/15*** | (2006.01) |
| ***B41J 2/145*** | (2006.01) |
| ***B41J 2/045*** | (2006.01) |

(52) U.S. Cl. ..... 347/12; 347/40; 347/68

(58) Field of Classification Search ..... None
See application file for complete search history.

(56) References Cited

U.S. PATENT DOCUMENTS

| | | | | |
|---|---|---|---|---|
| 5,754,193 | A | 5/1998 | Elhatem | |
| 5,754,201 | A | 5/1998 | Ishinaga et al. | |
| 6,137,502 | A | 10/2000 | Anderson et al. | |
| 6,293,655 | B1 * | 9/2001 | Imanaka et al. | 347/65 |
| 6,409,315 | B2 | 6/2002 | Komuro | |
| 6,431,685 | B1 | 8/2002 | Misumi | |
| 6,474,790 | B2 | 11/2002 | Kaneko | |
| 6,966,629 | B2 | 11/2005 | Nakajima et al. | |
| 7,309,120 | B2 | 12/2007 | Hatsui et al. | |
| 7,819,493 | B2 | 10/2010 | Hirayama et al. | |
| 2002/0089565 | A1 * | 7/2002 | Lopez et al. | 347/43 |
| 2002/0118241 | A1 * | 8/2002 | Fujii | 347/12 |
| 2006/0238558 | A1 * | 10/2006 | Hatasa et al. | 347/20 |
| 2007/0091131 | A1 | 4/2007 | Hatsui et al. | |
| 2007/0165055 | A1 | 7/2007 | Hirayama et al. | |
| 2007/0296745 | A1 | 12/2007 | Kasai et al. | |
| 2008/0100649 | A1 | 5/2008 | Matsui et al. | |
| 2008/0111864 | A1 | 5/2008 | Yamaguchi et al. | |
| 2011/0012950 | A1 | 1/2011 | Hirayama et al. | |

FOREIGN PATENT DOCUMENTS

| | | | |
|---|---|---|---|
| CN | 1163828 | A | 11/1997 |
| EP | 1543972 | A1 | 6/2005 |
| JP | 2002-374163 | A | 12/2002 |
| TW | I249472 | B | 2/2006 |
| TW | I253402 | B | 4/2006 |

* cited by examiner

*Primary Examiner* — Stephen Meier
*Assistant Examiner* — Alexander C Witkowski
(74) *Attorney, Agent, or Firm* — Fitzpatrick, Cella, Harper & Scinto

(57) ABSTRACT

This invention is directed to a print element substrate including a plurality of print element arrays in which different numbers of print elements are arranged. The print element substrate can efficiently transfer data to each print element and efficiently lay out circuits. The print element substrate includes the following arrangement. More specifically, a first print element array having a relatively large number of print elements, and a plurality of second print element arrays which are equal in length to the first print element array and smaller in the number of print elements than the first print element array are juxtaposed. The print element substrate includes one shift register which holds data for driving the print elements of the first print element array, and one shift register which holds data for driving the print elements of the second print element arrays.

8 Claims, 13 Drawing Sheets

PRINT ELEMENT SUBSTRATE, PRINTHEAD, AND PRINTING APPARATUS

BACKGROUND OF THE INVENTION

1. Field of the Invention

The present invention relates to a print element substrate including a plurality of print element arrays in which different numbers of print elements are arrayed, a printhead, and a printing apparatus.

2. Description of the Related Art

A printhead which prints on a printing medium by discharging ink according to a thermal inkjet method includes, as print element building elements in the printhead, heaters formed from heat generation elements. Drivers for driving heaters, and logic circuits for selectively driving the drivers in accordance with print data are formed on a single element substrate of the printhead.

The resolution of thermal inkjet type color inkjet printing apparatuses is increasing year by year. Along with this, the orifice arrangement density of a printhead is set to discharge ink in the range of a resolution of 600 dpi to resolutions of 900 dpi and 1,200 dpi. There is known a printhead having orifices at such high density.

Demand has arisen for reducing graininess at a halftone portion or highlight portion in a gray image and color photo image. To meet this demand, the size of an ink droplet (liquid droplet) discharged to form an image was about 15 pl several years ago, but is recently decreasing to 5 pl and then 2 pl year after year in a printhead which discharges color ink.

A high-resolution printhead in which orifices for discharging small ink droplets are arranged at high density satisfies a user need for high-quality printing when printing a high-quality color graphic image or photo image. However, when not high-resolution printing but high-speed printing is required in, for example, printing a color graph in a spreadsheet, the above-mentioned printhead may not meet the demand for high-speed printing because printing with small ink droplets increases the number of print scan operations.

To achieve even high-speed printing, there has been proposed a printhead which discharges small ink droplets for high-quality printing and large ink droplets for high-speed printing. There have also been known a printhead in which a plurality of heaters are arranged for one orifice to change the discharge amount by these heaters, and a printhead in which a plurality of orifices having different discharge amounts are arranged in one element substrate.

Element substrates having a plurality of orifices for discharging different amounts of ink include an element substrate in which an orifice array (small-droplet orifice array) of orifices for discharging small ink droplets, and an orifice array (large-droplet orifice array) of orifices for discharging large ink droplets are juxtaposed. To achieve high-quality printing at high speed by this element substrate, there is proposed an element substrate in which the orifice arrangement density of a small-droplet orifice array is higher than that of a large-droplet orifice array. An example of this element substrate is one having a large-droplet orifice array in which 600 orifices are arranged per inch (arrangement density is 600 dpi), and a small-droplet orifice array in which 1,200 orifices double in number are arranged per inch (arrangement density is 1,200 dpi). Examples of this element substrate are arrangements disclosed in the U.S. Pat. Nos. 6,409,315, 6,474,790, 5,754,201, and 6,137,502, and Japanese Patent Laid-Open No. 2002-374163.

Recent inkjet printing apparatuses discharge small ink droplets to print a high-quality image. At the same time, these inkjet printing apparatuses need to increase the print speed. Simply forming the same image requires the same ink amount. Thus, if the discharged ink droplet is downsized to decrease the discharged ink amount to ½, the print speed simply decreases to ½.

To discharge the same ink amount in the same time in order to prevent a decrease in print speed, the number of heaters needs to be doubled. However, if the number of heaters is doubled without changing the heater arrangement density, the size of an element substrate in which heaters are arranged increases double or more. In addition to the increase in element substrate size, this also increases the size of the printhead which moves at high speed in the printing apparatus, the size of the printing apparatus, and vibrations and noise. To prevent these, the heater arrangement density needs to be increased.

To stably discharge ink, a stable voltage needs to be applied to heaters. When all heaters are driven concurrently, a large current flows, and the voltage greatly drops owing to the wiring resistance. To solve this, there is a time-divisional driving method of dividing a plurality of heaters on an element substrate into a plurality of blocks, and sequentially driving heaters for the respective blocks time-divisionally to stably discharge ink.

Recent inkjet printing apparatuses adopt a printhead having an element substrate in which a small-droplet orifice array and large-droplet orifice array are juxtaposed, and heaters corresponding to the respective arrays are arranged. Further, these inkjet printing apparatuses achieve both high-speed printing and high-quality printing by selectively driving orifices for discharging small ink droplets and those for discharging large ink droplets. However, to implement both high-speed printing and high-quality printing, the numbers of orifices and heaters integrated on the element substrate need to be increased.

An element substrate including a large-droplet orifice array at an arrangement density of 600 dpi and a small-droplet orifice array with a double number of orifices at a double arrangement density of 1,200 dpi, which are arranged on a single substrate, will be exemplified. In this element substrate, when printing one pixel by one bit, the number of heaters directly equals the number of bits of print data. The data amount necessary for the orifice array at the arrangement density of 1,200 dpi is double the data amount necessary for the orifice array at the arrangement density of 600 dpi. The difference in data amount is directly related to the data transfer speed. Heaters in different arrays can be driven at individual driving frequencies as long as a clock signal is prepared for each print data corresponding to an orifice array. Even when the time-divisional count and data amount differ between orifice arrays, data can be transferred within almost the same time. In a case where orifice arrays at arrangement densities of 600 dpi and 1,200 dpi coexist, data can be transferred within almost the same time by transferring data to the 1,200-dpi orifice array at double the speed of the 600-dpi orifice array.

However, preparing a clock signal line for each print data signal line corresponding to an orifice array increases the number of pads of the element substrate and the number of signal lines between the printhead and the printing apparatus main body. As the numbers of pads and signal lines increase, the apparatus including the element substrate, printhead, and printing apparatus main body becomes bulky.

To prevent this, an element substrate which includes a plurality of orifice arrays at different arrayed densities and performs time-divisional driving employs the following arrangement. More specifically, a common clock signal CLK is used, and the data transfer speed is set proportional to the number of data bits held in a shift register used for transfer. Data is transferred for each orifice array. Thus, the number of data bits which need to be held in the shift register differs between high- and low-density orifice arrays in time-divisional driving. This difference leads to a transfer speed difference. That is, the transfer speed for the high-density orifice array for which the shift register needs to hold a large number of bits decreases. For example, assume that the number of bits in the shift register used for transfer is 6 bits (4 bits for print data and 2 bits for block control data) in a shift register corresponding to a 600-dpi orifice array, and 10 bits (8 bits for print data and 2 bits for block control data) in a shift register corresponding to a 1,200-dpi orifice array. Under this condition, the data transfer speed of the 6-bit shift register complies with that of the 10-bit shift register. Hence, the 6-bit shift register transfers data at 6/10 of the original data transfer speed, decreasing the data transfer speed.

The area of a circuit pattern including a shift register depends on the number of data bits held in the shift register. If the number of bits differs between a shift register corresponding to a high-density orifice array and that corresponding to a low-density orifice array, the area of the circuit pattern also differs between them, decreasing the circuit layout efficiency. Along with recent demand for smaller-size printing apparatuses, more compact printheads are required. Under the restriction on the printhead size, it is necessary to lay out circuits more efficiently.

SUMMARY OF THE INVENTION

Accordingly, the present invention is conceived as a response to the above-described disadvantages of the conventional art.

For example, a print element substrate including a plurality of print element arrays in which different numbers of print elements are arranged according to this invention is capable of efficiently laying out circuits, and is capable of efficiently transferring data to each print element.

According to one aspect of the present invention, preferably, there is provided a print element substrate comprising: a first print element array having a plurality of print elements; a second print element array having a plurality of print elements; a first driving circuit which divides the plurality of print elements included in the first print element array into a predetermined number of groups and time-divisionally drives print elements belonging to each group; a second driving circuit which divides the plurality of print elements included in the second print element array into the predetermined number of groups and time-divisionally drives print elements belonging to each group; and a shift register circuit which holds data for driving the print elements belonging to the first print element array, data for driving the print elements belonging to the second print element array, and information for selecting print elements to be driven from print elements belonging to the respective groups of the first print element array and the second print element array.

According to another aspect of the present invention, preferably, there is provided a printhead having the above print element substrate.

According to still another aspect of the present invention, preferably, there is provided a printing apparatus having a carriage to which the above printhead can be attached.

The invention is particularly advantageous since data can be transferred to each print element efficiently and circuits can be laid out efficiently in an element substrate including a plurality of print element arrays in which different numbers of print elements are arranged.

Further features of the present invention will become apparent from the following description of exemplary embodiments with reference to the attached drawings.

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Furthermore, an element substrate (substrate for a printhead) in the description not only includes a simple substrate made of a silicon semiconductor, but also broadly includes an arrangement having elements, wires, and the like.

The expression "on a substrate" not only includes "on an element substrate", but also broadly includes "on the surface of an element substrate" and "inside of an element substrate near its surface". The term "built-in" in the invention not only includes "simply arrange separate elements on a substrate", but also broadly includes "integrally form and manufacture elements on an element substrate by a semiconductor circuit manufacturing process or the like".

<Inkjet Printing Apparatus>

Figure 11:
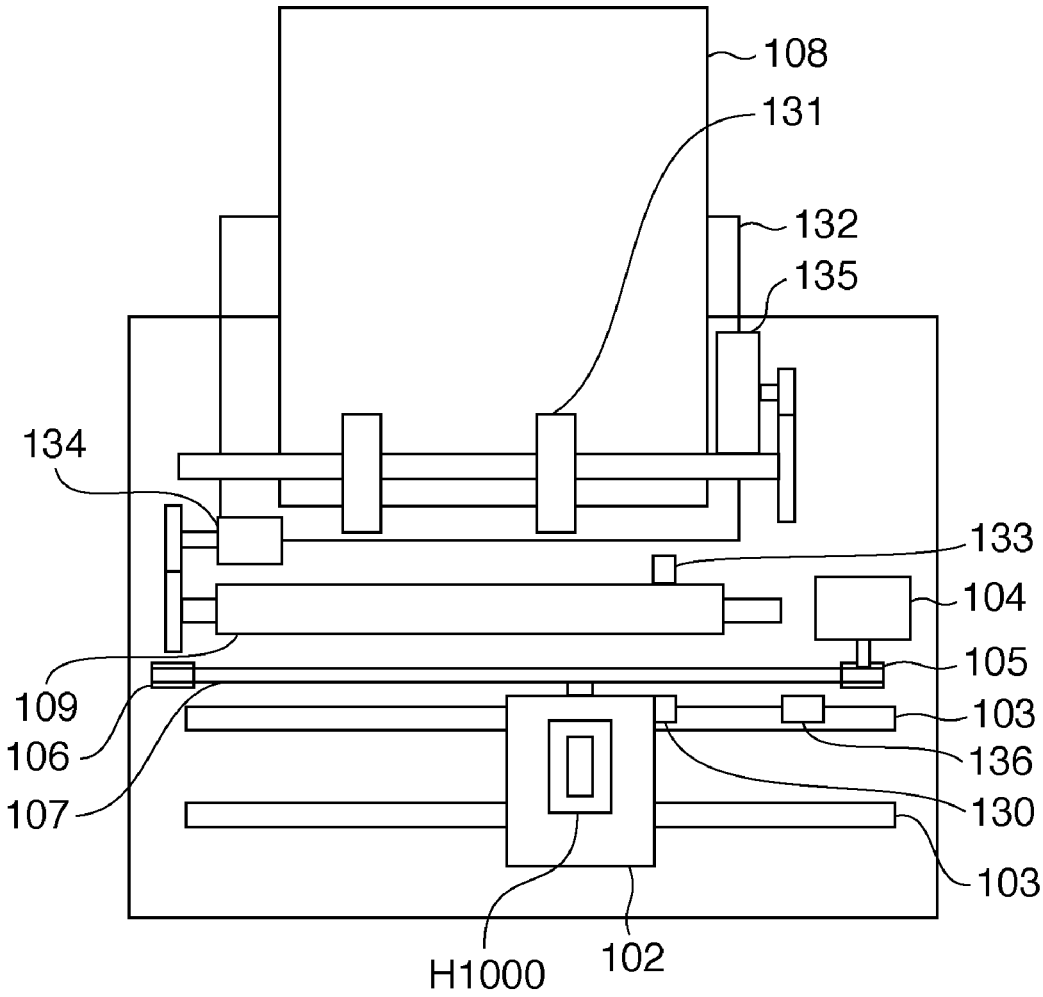
FIG. 11 is a schematic view showing an inkjet printing apparatus as a typical embodiment of the present invention.

A printing apparatus capable of mounting a printhead including an element substrate according to the present invention will be explained. FIG. 11 is a schematic view showing an example of an inkjet printing apparatus capable of mounting a printhead according to the present invention.

In the inkjet printing apparatus (to be also simply referred to as a printing apparatus hereinafter) shown in FIG. 11, a head cartridge H1000 is configured by combining a printhead including an element substrate according to the present invention, and a container which stores ink. The head cartridge H1000 is positioned and exchangeably mounted on a carriage 102. The carriage 102 includes an electrical connection for transmitting a driving signal and the like to each discharge portion via an external signal input terminal on the head cartridge H1000.

The carriage 102 is guided and supported reciprocally along guide shafts 103, which elongates in a main scanning direction, provided to the printing apparatus main body. A carriage motor 104 drives the carriage 102 via a driving mechanism including a motor pulley 105, associate pulley 106, and timing belt 107. Further, the carriage motor 104 controls the position and movement of the carriage 102.

An auto sheet feeder (ASF) 132 feeds printing media 108 separately one by one as a feed motor 135 rotates a pickup roller 131 via a gear. As a conveyance roller 109 rotates, the printing medium 108 is conveyed (sub-scanned) via a position (printing portion) facing the orifice surface of the head cartridge H1000. The conveyance roller 109 rotates via a gear as a conveyance motor 134 rotates. When the printing medium 108 passes through a paper end sensor 133, the paper end sensor 133 determines whether the printing medium 108 has been fed, and finalizes the start position upon paper feed.

The head cartridge H1000 mounted on the carriage 102 is held so that the orifice surface extends downward from the carriage 102 and becomes parallel to the printing medium 108 between the pair of two conveyance rollers.

The carriage 102 supports the head cartridge H1000 so that the orifice arrangement direction of the printhead coincides with a direction perpendicular to the scanning direction of the carriage 102. The head cartridge H1000 discharges liquid from orifice arrays to print.

<Control Arrangement>

A control arrangement for executing printing control of the above-described inkjet printing apparatus will be explained.

Figure 12:
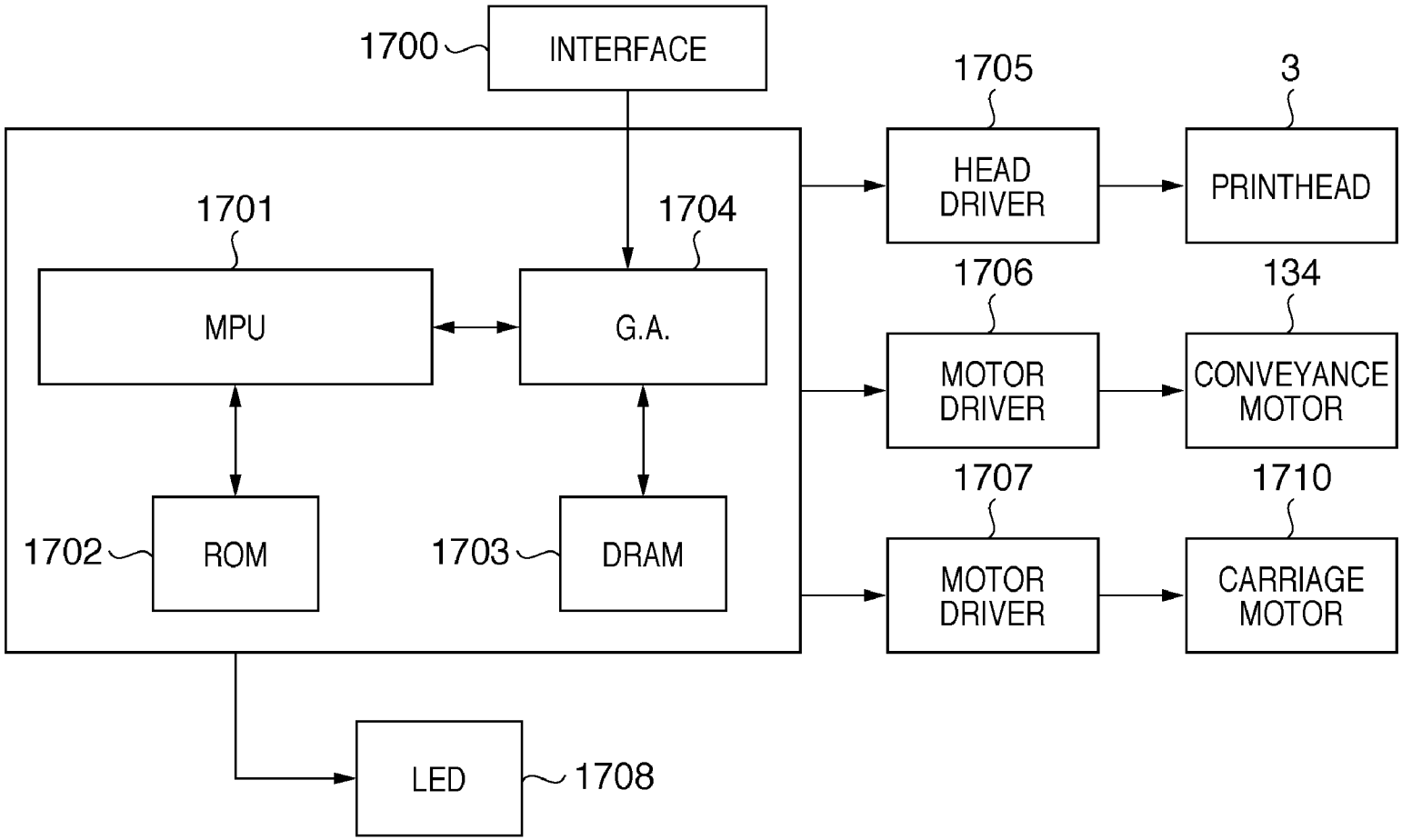
FIG. 12 is a block diagram showing the control arrangement of the inkjet printing apparatus shown in FIG. 11.

FIG. 12 is a block diagram showing the arrangement of the control circuit of the inkjet printing apparatus.

Referring to FIG. 12, an interface 1700 inputs a print signal. A ROM 1702 stores a control program to be executed by an MPU 1701. A DRAM 1703 saves various data (e.g., print data supplied to a printhead 3 of the head cartridge H1000). A gate array (G.A.) 1704 controls supply of print data to the printhead 3. The gate array 1704 also controls data transfer between the interface 1700, the MPU 1701, and the RAM 1703. A carriage motor 1710 conveys the head cartridge H1000 having the printhead 3. The conveyance motor 134 conveys a printing medium. A head driver 1705 drives the printhead 3, a motor driver 1706 drives the conveyance motor 134, and a motor driver 1707 drives the carriage motor 1710. For example, when the electrical connection is abnormal, an LED 1708 is turned on to notify this.

The operation of this control arrangement will be explained. When a print signal is input to the interface 1700, it is converted into print data between the gate array 1704 and the MPU 1701. Then, the motor drivers 1706 and 1707 are driven. At the same time, the printhead 3 is driven in accordance with the print data sent to the head driver 1705, thereby printing.

<Head Cartridge>

Figure 13:
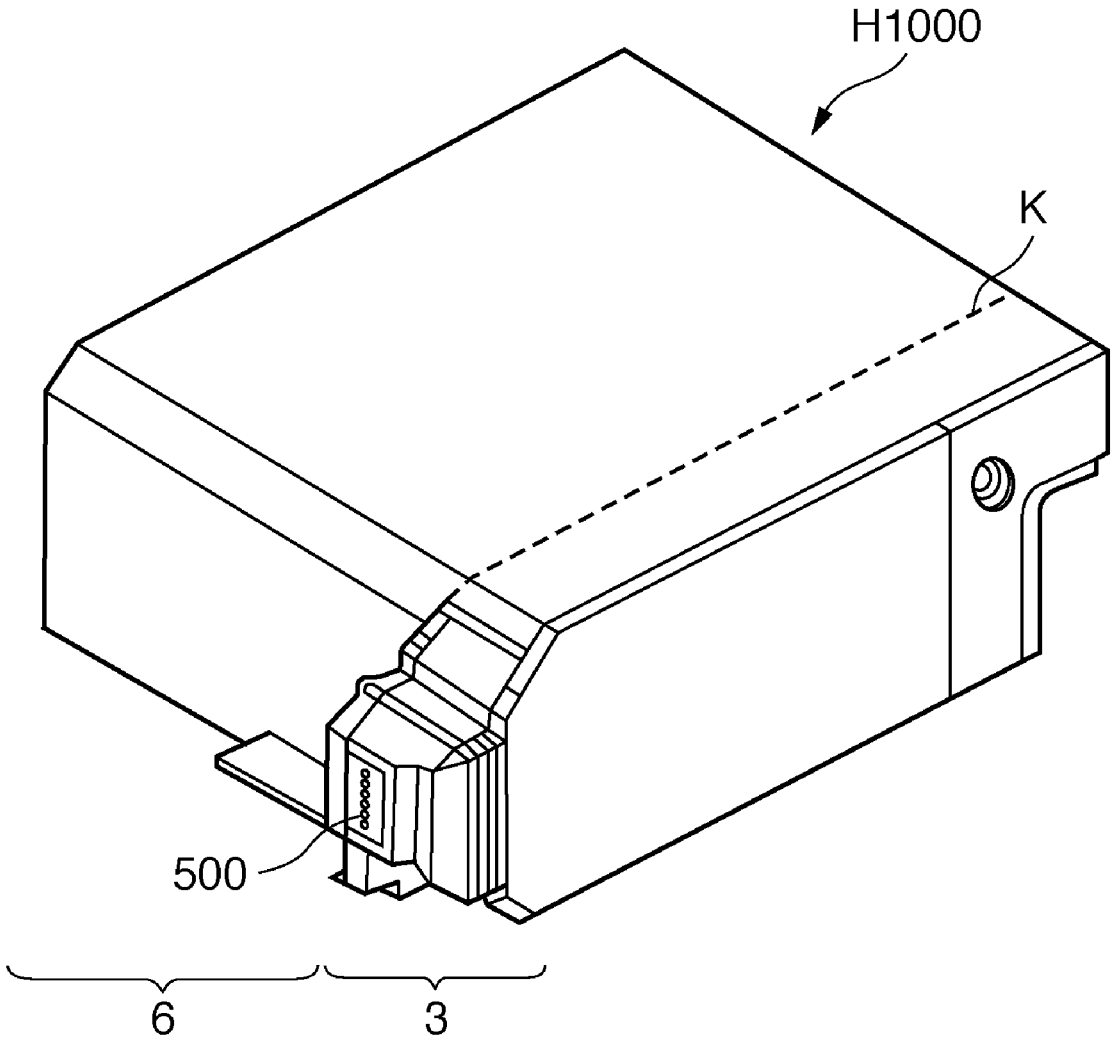
FIG. 13 is a perspective view showing the outer appearance of a head cartridge which integrates an ink tank and printhead.

FIG. 13 is a perspective view showing the outer appearance of the head cartridge H1000 which integrates an ink tank 6 and the printhead 3. Referring to FIG. 11, a dotted line K indicates the boundary between the ink tank 6 and the printhead 3. An ink orifice array 500 is an array of orifices. Ink stored in the ink tank 6 is supplied to the printhead 3 via an ink supply channel (not shown). The head cartridge H1000 has an electrode (not shown) for receiving an electrical signal supplied from the carriage 102 when the head cartridge H1000 is mounted on the carriage 102. The electrical signal drives the printhead 3 to selectively discharge ink from the orifices of the orifice array 500.

<Element Substrate>

Figure 6:
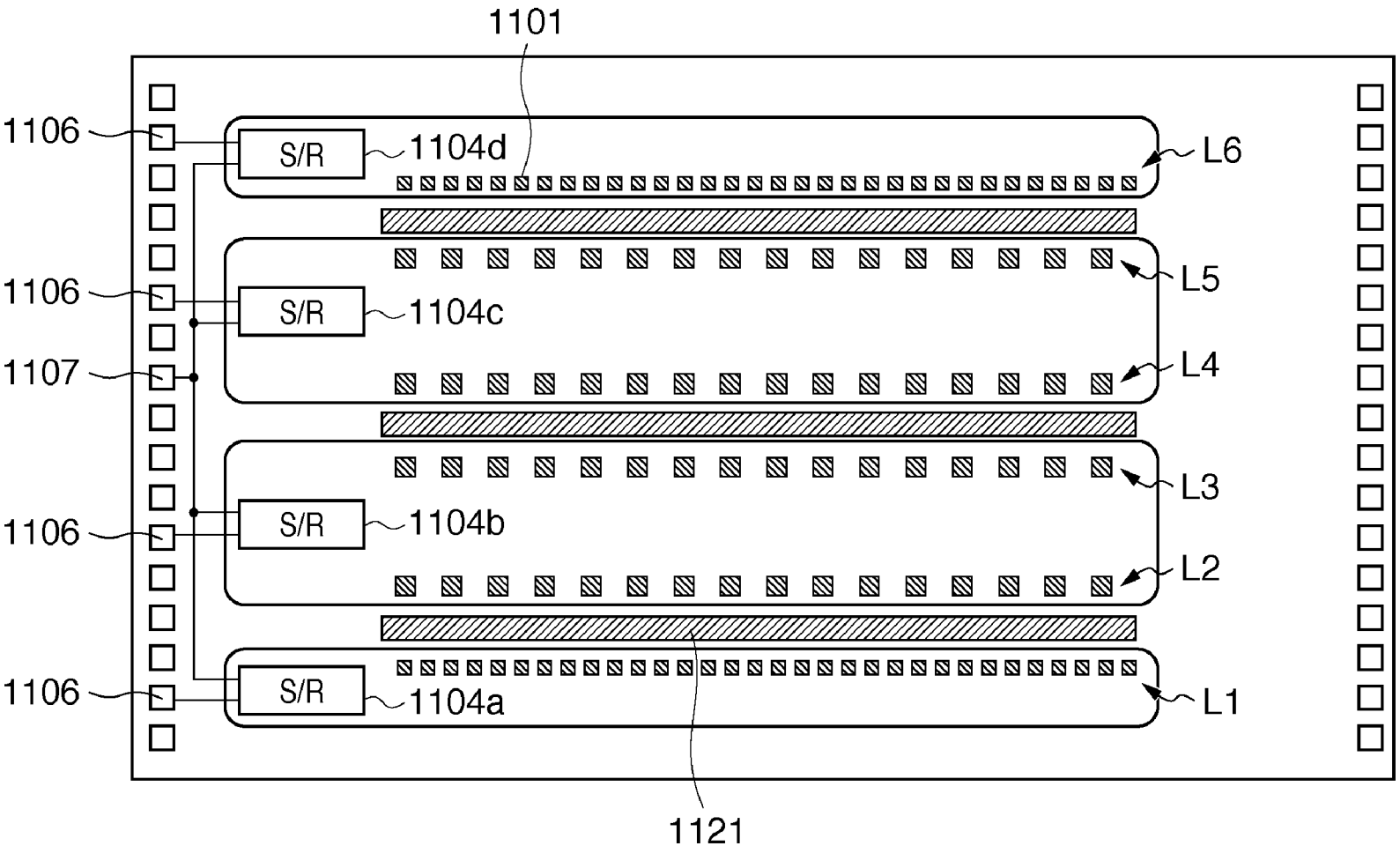
FIG. 6 is a schematic view of an element substrate according to the present invention.
Figure 8:
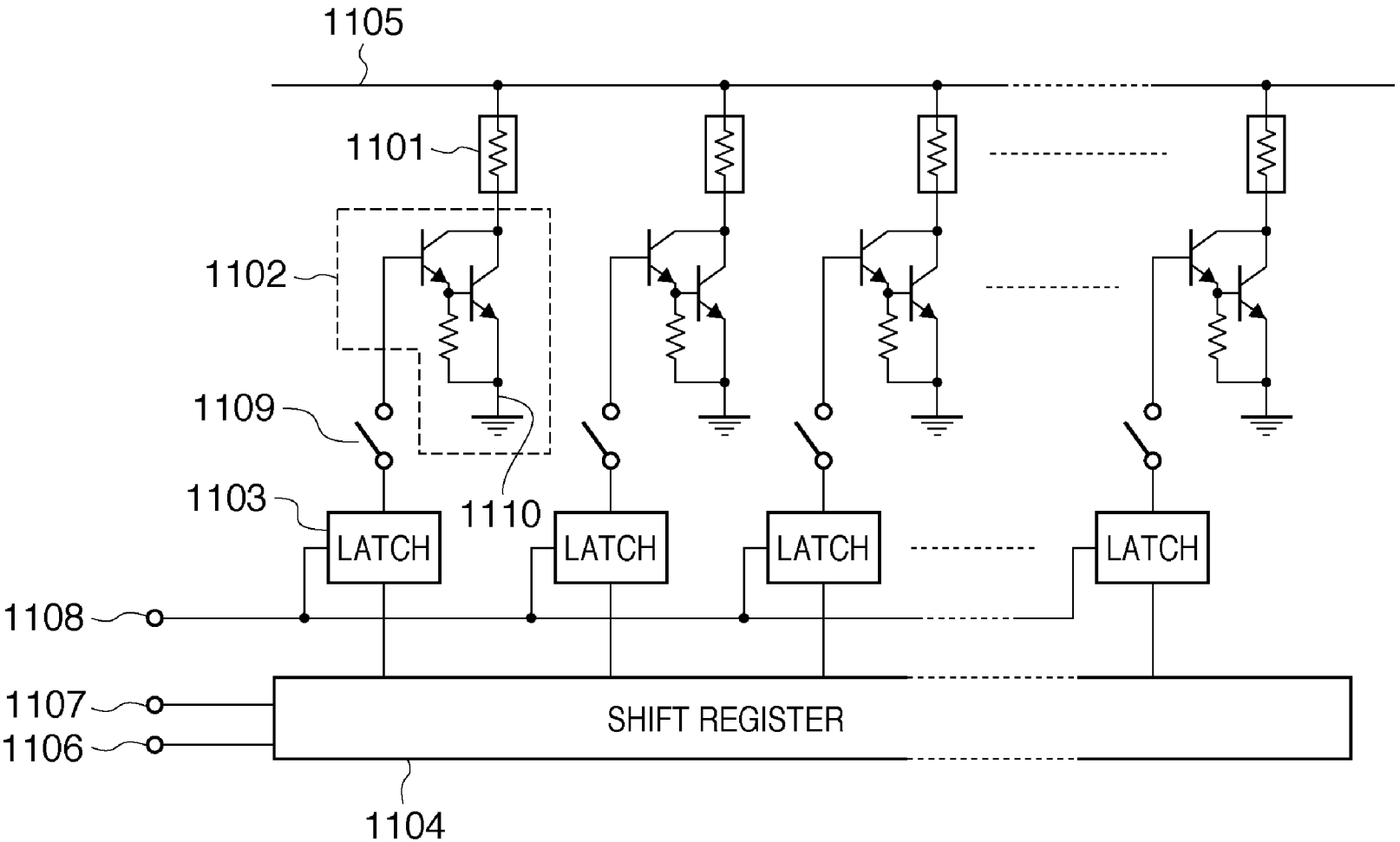
FIG. 8 is a diagram showing an example of the circuit arrangement of the element substrate.

An element substrate according to the present invention will be explained. FIG. 8 shows an example of the circuit arrangement of the element substrate. As shown in FIG. 6, heaters serving as print elements in the printhead, and their driving circuit are formed on a single substrate using a semiconductor process.

Referring to FIG. 8, each heater 1101 generates thermal energy, and each transistor (transistor unit) 1102 supplies a desired current to the heater 1101. A shift register 1104 temporarily stores print data which designates whether to supply a current to each heater 1101 and discharge ink from the orifice of the printhead. The shift register 1104 has a clock (CLK) input terminal 1107. A print data input terminal 1106 serially receives print data DATA for turning on/off the heater 1101. For each heater, a corresponding latch circuit 1103 latches print data of the heater. A latch signal input terminal 1108 inputs a latch signal LT which instructs the latch circuit 1103 of the timing of latch. Each switch 1109 determines the timing to supply a current to the heater 1101. A power supply line 1105 applies a predetermined voltage to the heater to supply a current. A ground line 1110 grounds the heater 1101 via the transistor 1102.

Figure 9:
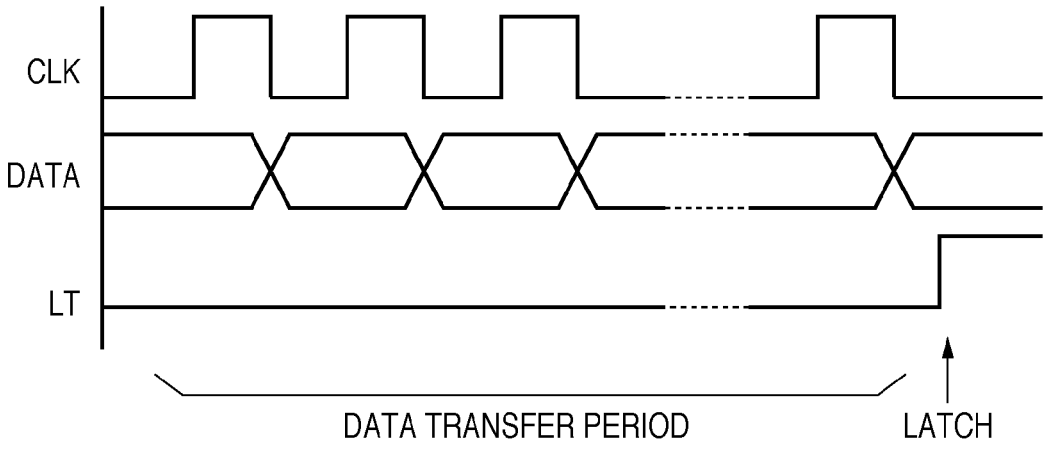
FIG. 9 is a timing chart of an example of various signals input to the element substrate.

FIG. 9 is a timing chart of various signals input to the element substrate shown in FIG. 8. Heater driving and the like on the element substrate shown in FIG. 8 will be explained with reference to FIG. 9.

The clock input terminal 1107 receives clocks CLK by the number of bits of print data stored in the shift register 1104. Data is transferred to the shift register 1104 in synchronism with the leading edge of the clock CLK. Print data DATA for turning on/off each heater 1101 is input from the print data input terminal 1106.

An element substrate in which the number of bits of print data stored in the shift register 1104 is equal to that of heaters and that of power transistors for driving heaters will be explained for descriptive convenience. Pulses of the clock CLK are input by the number of heaters 1101, and the print data DATA is transferred to the shift register 1104. Then, the latch signal LT is input from the latch signal input terminal 1108, and the latch circuit 1103 latches print data corresponding to each heater. The switch 1109 is turned on for an appropriate time. Then, a current flows through the transistor 1102 and heater 1101 via the power supply line 1105 in accordance with the ON time of the switch 1109. The current flows into the GND line 1110. At this time, the heater 1101 generates heat necessary to discharge ink, and the orifice of the printhead discharges ink in correspondence with print data.

A time-divisional driving method will be explained with reference to FIG. 7. According to the time-divisional driving method, heaters are divided into a plurality of blocks, and the heaters are driven by changing the time for each block, instead of concurrently driving all the heaters of a single heater array. The time-divisional driving method can decrease the number of concurrently driven heaters.

For example, an arrangement in which all the heaters of a single heater array are divided into m groups each having N ($N=2^n$: n is a positive integer) heaters will be considered. In this arrangement, N heaters belonging to one group are time-divisionally driven. When time-divisionally driving heaters in the m respective groups, heaters are driven at the same timing across plural groups. Concurrently driven heaters across plural groups will be called a block. Assume that N heaters in one group are driven in N-time division. If the number of heaters in one group equals the time-divisional count, the number of concurrently driven heaters across plural groups is m because the number of groups is m. Thus, the number of blocks is also N.

Data held in the shift register are a "block selection signal" for selecting a heater corresponding to time division, and a "print data signal" in time division. For N-divisional driving, $N=2^n$ via the decoder, and signals input to the shift register are an n-bit block selection signal and an m-bit print data signal. The block selection signal from the shift register is input to a decoder 1203, and output as m block selection signals. In FIG. 7, N=4, and every five heaters are driven concurrently.

The decoder 1203 receives block control data to generate a block selection signal based on the block control data. Each AND circuit 1201 builds part of the driving circuit of the heater 1101. The AND circuit 1201 is arranged in correspondence with each heater 1101. The number of bits in the shift register 1104 and latch circuit 1103 is n+m bits. In N-time-divisional driving, (n+m)-bit data is input N times, thereby inputting driving signals in one-to-one correspondence with heaters. In other words, in this element substrate, to drive all the heaters of the hater array once, the gate array 1704 outputs (n+m)-bit data formed from print data and block control data N times.

<Method of Manufacturing Element Substrate and Printhead>

A method of manufacturing an element substrate according to the present invention and a printhead including the element substrate will be explained for a part associated with the present invention.

Figure 10:
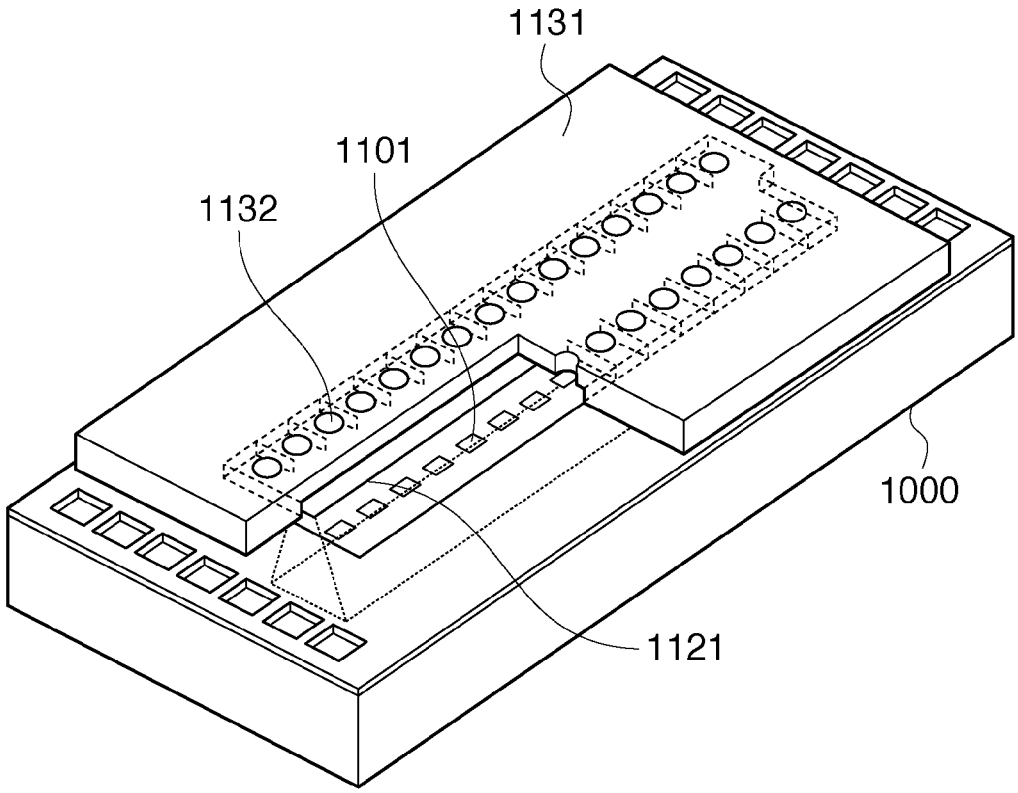
FIG. 10 is a perspective view showing an example of the element substrate.

FIG. 10 is a perspective view showing an example of the element substrate according to the present invention. On the surface of an element substrate 1000, the heaters 1101 and their driving circuits are formed by a semiconductor process using an Si wafer with 0.5 to 1 mm thickness. Each orifice 1132 for discharging ink is formed by photolithography using an orifice forming member 1131 made of a resin material, together with an ink channel wall for forming an ink channel corresponding to each heater 1101 of the element substrate 1000.

To supply ink to each orifice 1132, an ink supply port 1121, which is a long groove-like through-hole with a surface inclined from the lower surface to upper surface of the element substrate, is formed by anisotropic etching using the crystal orientation of the Si wafer.

The element substrate having this structure can build a head cartridge by connecting the ink supply port 1121 and a channel member for guiding ink to the ink supply port 1121, and combining them with a container which stores ink. Particularly when the head cartridge is configured by combining containers which store inks of a plurality of colors, and element substrates for the respective colors, color printing can be performed using this head cartridge.

<Driving Circuit in Element Substrate>

Figure 7:
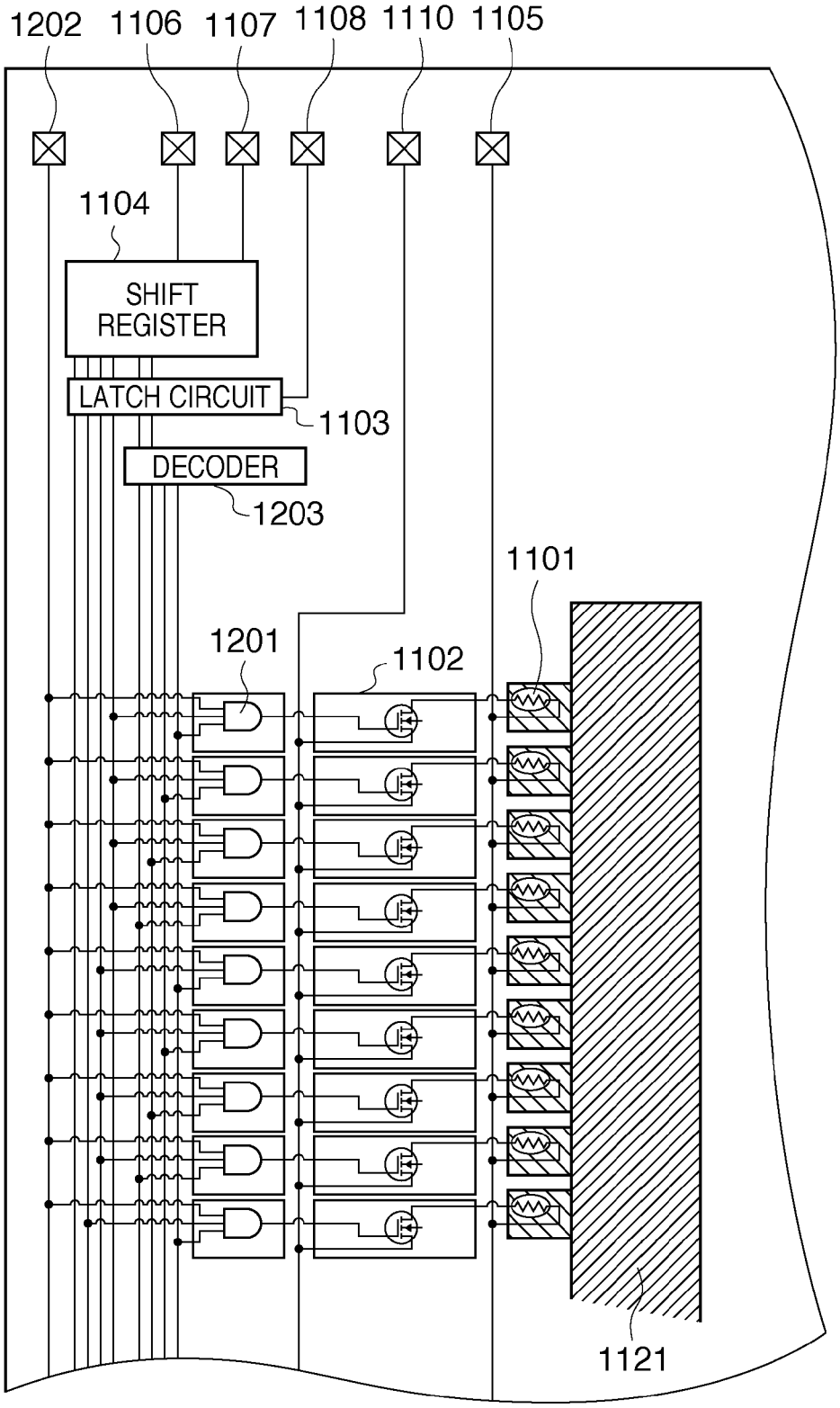
FIG. 7 is an example of a block diagram of the element substrate, shown in FIG. 5, including a driving circuit.

FIG. 7 is a block diagram including an example of part of the driving circuit of an element substrate according to the present invention. The element substrate employs a multilayer wiring technique. Insulating layers sandwich an interconnection (interconnection made of aluminum, copper, gold, or an alloy containing aluminum, copper, or gold) which connects building elements. A plurality of interconnection layers are formed on the element substrate. Each interconnection layer is connected to its upper and lower interconnection layers via through-holes (openings of the insulating layers) at any desired portions in the element substrate.

In the element substrate shown in FIG. 7, an ink supply port 1121 supplies ink from the lower surface of the element substrate to orifices. A plurality of heaters 1101 are arranged at high density along the ink supply port 1121.

Several embodiments of a heater array and shift register in the element substrate according to the present invention will be explained below in detail.

Element substrates in the following embodiments are those for an inkjet printhead. In these element substrates, a plurality of heater arrays each including a plurality of heaters are arranged along the ink supply port 1121. More specifically, each element substrate includes a heater array (first print element array) made up of a relatively large number of heaters serving as print elements, and a heater array (second print element array) made up of a relatively small number of heaters as printing elements. In the following embodiments, both the number of heaters (number of print elements) and the heater arrayed density differ between heater arrays to clarify features of the present invention. However, the present invention is also applicable to a case where the heater arrayed density is equal and only the number of heaters differs between heater arrays.

First Embodiment

In an element substrate according to the first embodiment, the number of heaters of a heater array in which heaters are arranged at high density (1,200 dpi) is 32. The number of heaters of a heater array in which heaters are arranged at low density (600 dpi) is 16, which is ½ of the number of heaters of the heater array in which heaters are arranged at high density. These juxtaposed heater arrays are equal in length. The heater array in which heaters are arranged at low density and the heater array in which heaters are arranged at high density are driven by the same time-divisional count. Time-divisional driving uses a common clock and latch signal within the element substrate. In the first embodiment, the number of heaters of the heater array in which heaters (print elements) are arranged at high density is larger than that of heaters of the heater array in which heaters are arranged at low density.

Figure 5:
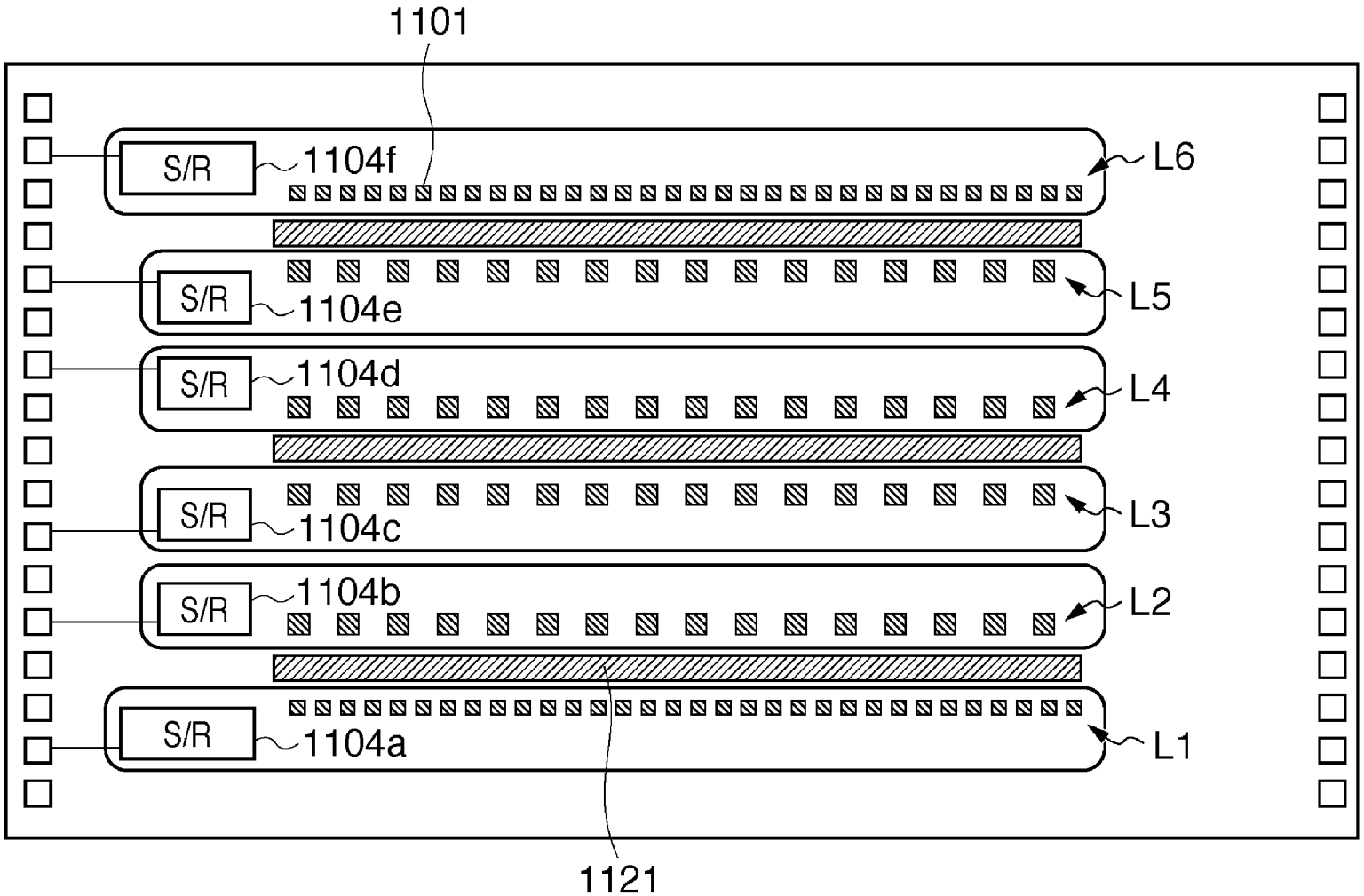
FIG. 5 is a schematic view of an element substrate for comparison with the element substrate according to the present invention.

FIG. 5 is a schematic view of a conventional element substrate. The element substrate includes six (6) heater arrays L1 to L6. In the heater arrays L1 and L6, heaters are arrayed at high density in the arrayed direction. In the heater arrays L2, L3, L4, and L5, heaters are arrayed at low density in the arrayed direction. For example, a shift register 1104*a* corresponds to the heater array L1. A shift register 1104*b* corresponds to the heater array L2. The remaining heater arrays and the remaining shift registers also have the same correspondence.

Figure 3:
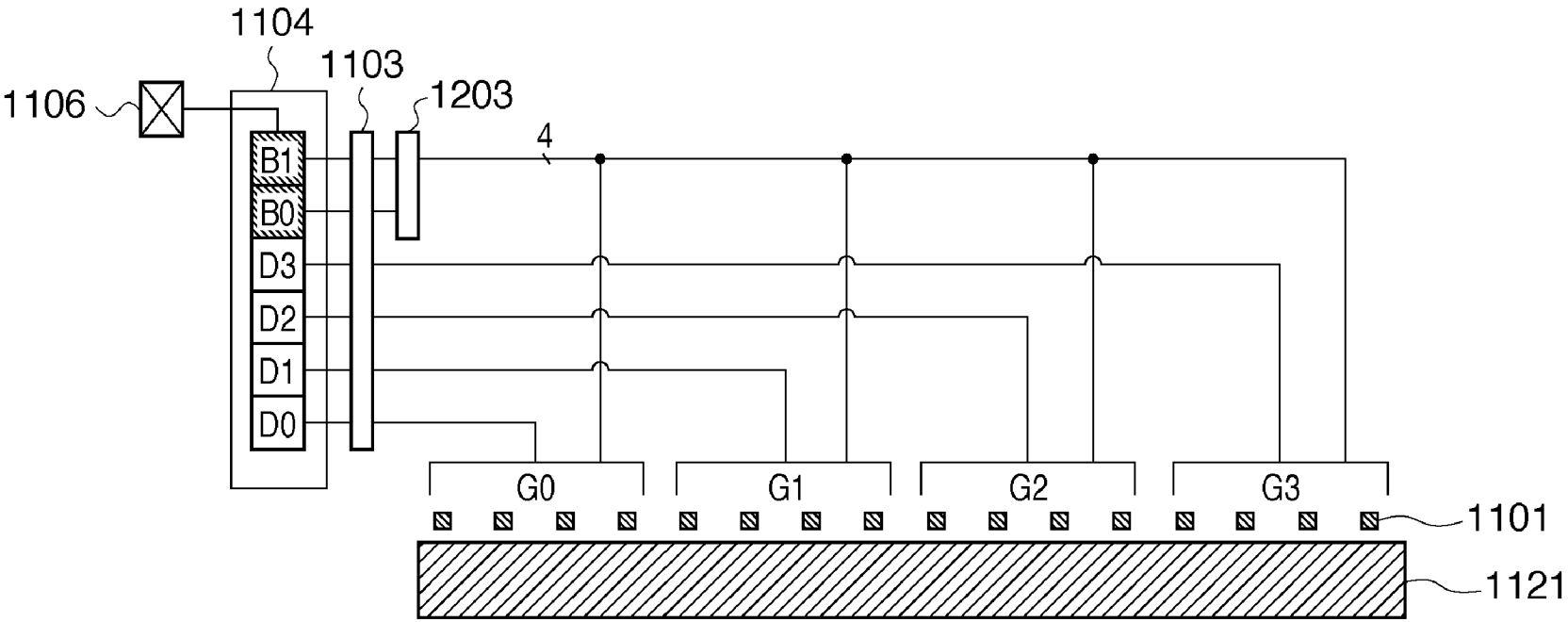
FIG. 3 is a block diagram of a heater array in which heaters are arrayed at low density and a shift register corresponding to the heater array in an element substrate, as a comparative example with respect to the embodiment according to the present invention.
Figure 4:
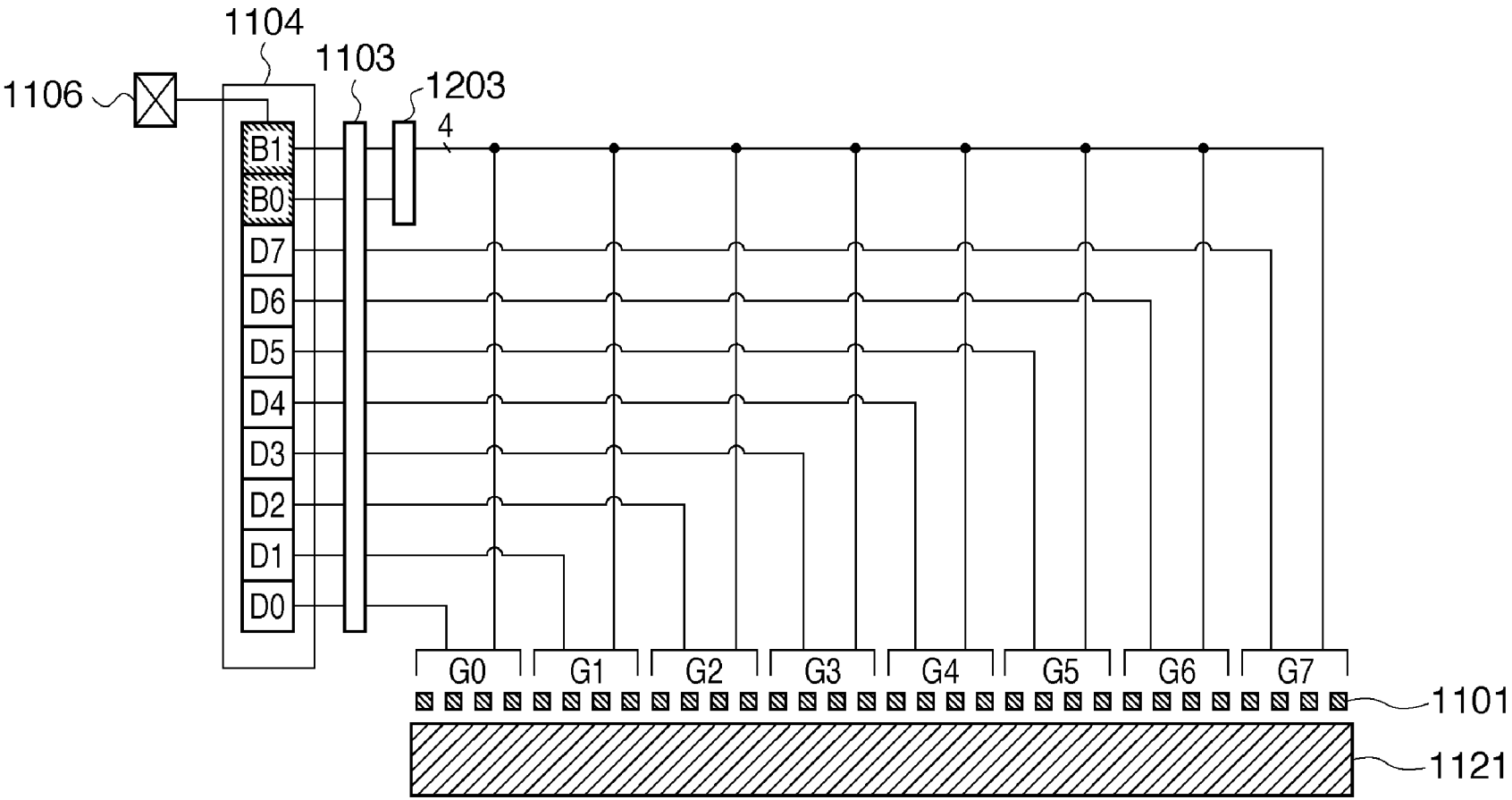
FIG. 4 is a block diagram of a heater array in which heaters are arrayed at high density and a shift register corresponding to the heater array in the element substrate shown in FIG. 3.

FIG. 3 is a block diagram showing the relationship between a heater array in which heaters are arranged at low density in the conventional element substrate, and the number of bits of a shift register. Similarly, FIG. 4 is a block diagram of the conventional element substrate for explaining the relationship between a heater array in which heaters are arranged at high density in the substrate, and the number of bits of a shift register. Generally in an element substrate having a plurality of ink supply ports, different types of inks such as cyan, magenta, and yellow inks are often discharged from nozzles corresponding to respective ink supply ports. A printhead having this element substrate needs to discharge inks of respective colors. Thus, respective nozzle arrays (heater arrays) need to be driven and controlled independently. In general, one shift register and one data input terminal are arranged for one nozzle array, as shown in FIG. 5. For this reason, a larger number of inks increase the number of terminals and the element substrate size.

In the element substrate of FIG. 5, a heater array in which heaters are arranged at low density includes four groups G0, G1, G2, and G3 each made up of four (4) adjacent heaters, as shown in FIG. 3. Also, this heater array includes four blocks each made up of a total of four heaters which are selected one by one from the respective groups and are concurrently driven. A shift register 1104 in FIG. 3 holds print data D0 to D3 of 4 bits for four groups, and block control data B0 and B1 of 2 bits for selecting a block to be driven from the four blocks. Thus, the number of bits of the shift register is 6.

FIG. 4 is a block diagram of a shift register, and a heater array in which heaters are arranged at high density in the element substrate of FIG. 5. The heater array in which heaters are arranged at high density includes eight (8) groups G0, G1, G2, G3, G4, G5, G6, and G7 each made up of four adjacent heaters. Also, this heater array includes four blocks each made up of a total of eight heaters which are selected one by one from the respective groups and are concurrently driven. A shift register 1104 shown in FIG. 4 holds print data D0 to D7 of 8 bits for eight groups, and block control data B0 and B1 of 2 bits for selecting a block to be driven from the four blocks. Thus, the number of bits of the shift register is 10.

The difference in the number of bits between the shift register corresponding to the heater array in which heaters are arranged at low density, and the shift register corresponding to the heater array in which heaters are arranged at high density in the element substrate of FIG. 5 is 4 bits. This difference in the number of bits appears as a data transfer speed.

On the other hand, in an element substrate according to the first embodiment, one shift register holds print data and block control data corresponding to a plurality of heater arrays in each of which heaters are arranged at low density.

FIG. 6 is a schematic view of the element substrate according to the first embodiment. The element substrate includes six (6) heater arrays L1 to L6. A shift register 1104*a* is arranged for the heater array L1. A shift register 1104*b* is arranged for the heater arrays L2 and L3. A shift register 1104*c* is arranged for the heater arrays L4 and L5. A shift register 1104*d* is arranged for the heater array L6.

Figure 1:
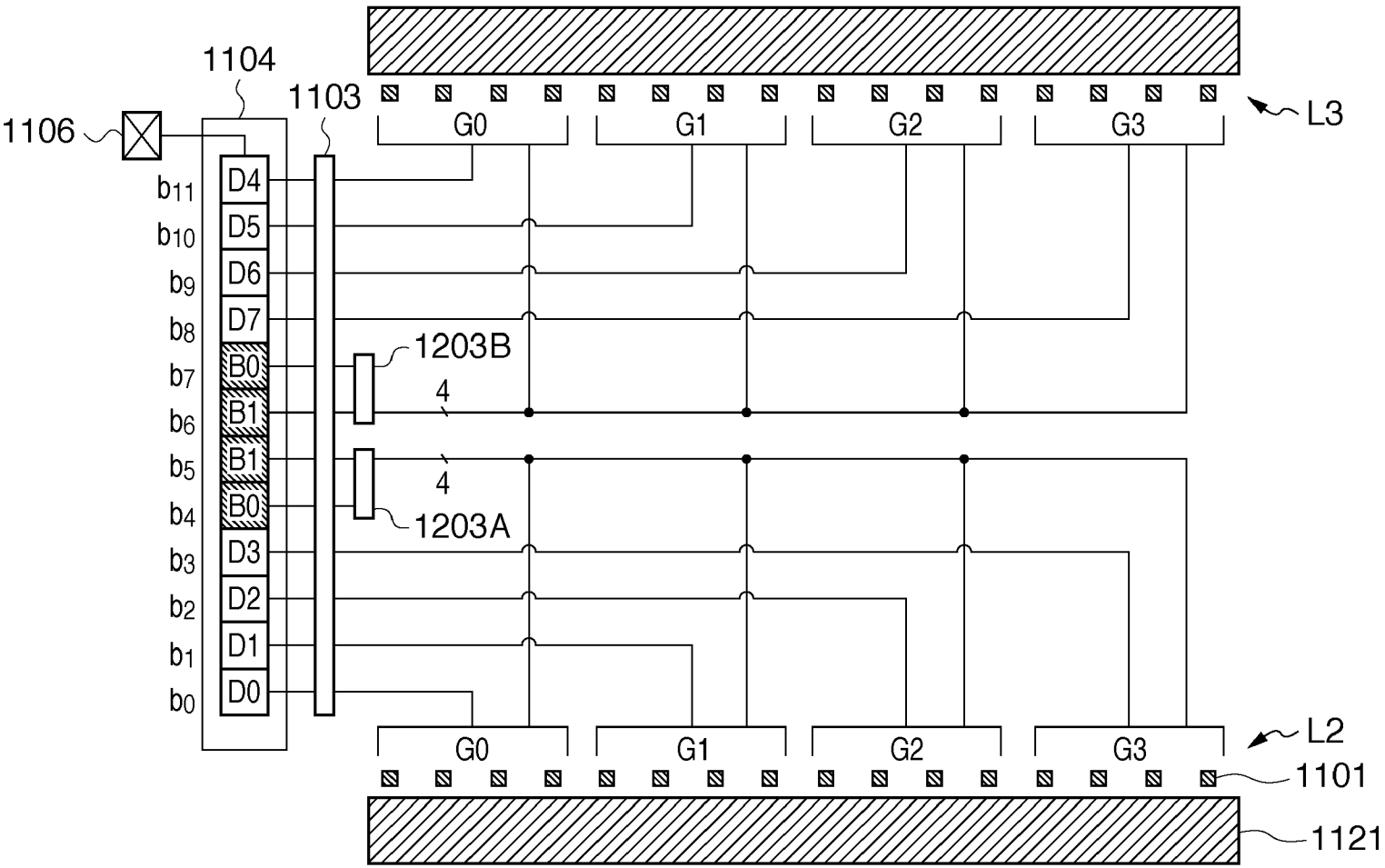
FIG. 1 is a block diagram of a heater array in which heaters are arrayed at low density and a shift register corresponding to the heater array in an element substrate, according to the first embodiment of the present invention.

FIG. 1 is a view for explaining the correspondence between two heater arrays and data held in a shift register. In the example of FIG. 6, this correspondence applies to the heater arrays L2 and L3 and the shift register 1104*b*. In FIG. 6, each shift register has a terminal 1106 for inputting an independent data signal. Each shift register receives a clock signal from a terminal 1107. This clock signal is shared. The shift register is configured by successively arraying circuit elements with the same arrangement by the number of data bits to be held. A circuit which corresponds to one data signal line and is configured by successively arraying circuit elements with the same arrangement will be defined as a shift register circuit.

Referring back to FIG. 1, a latch circuit 1103 will be explained. The latch circuit 1103 uses a 12-bit parallel bus to latch data held in the shift register 1104. As shown in FIG. 1, print data latched by the latch circuit 1103 is output to the heater arrays L2 and L3. More specifically, the latch circuit 1103 outputs data D0 to the group G0 of the heater array L2, data D1 to the group G1 of the heater array L2, data D2 to the group G2 of the heater array L2, and data D3 to the group G3 of the heater array L2. A decoder 1203A receives block control data B0 and B1 of 2 bits latched by the latch circuit 1103, generates control data of 4 bits, and outputs them to the respective groups of the heater array L2. In accordance with the control data, one heater to be driven is selected from each group of the heater array L2.

Similarly, the latch circuit 1103 outputs data D4, D5, D6, and D7 to the respective groups of the heater array L3. A decoder 1203B performs the same operation as that of the decoder 1203A. In the shift register 1104, the first area of bit 0 ($b_0$) to bit 3 ($b_3$) holds print data for the heater array L2. The second area of bit 4 ($b_4$) to bit 7 ($b_7$) holds control data. The third area of bit 8 ($b_8$) to bit 11 ($b_{11}$) holds print data for the heater array L3. Further, bit 4 ($b_4$) and bit 5 ($b_5$) in the second area hold control data for the heater array L2, and bit 6 ($b_6$) and bit 7 ($b_7$) hold control data for the heater array L3.

The shift register 1104 shown in FIG. 1 integrates shift register circuits corresponding to two heater arrays in both of which the number of print elements of the print element array is 16. In other words, shift register circuits respectively arranged for two print element arrays are continuously arrayed and combined into a single shift register circuit. This shift register circuit has one terminal 1106 for inputting a data signal.

Figure 14A:
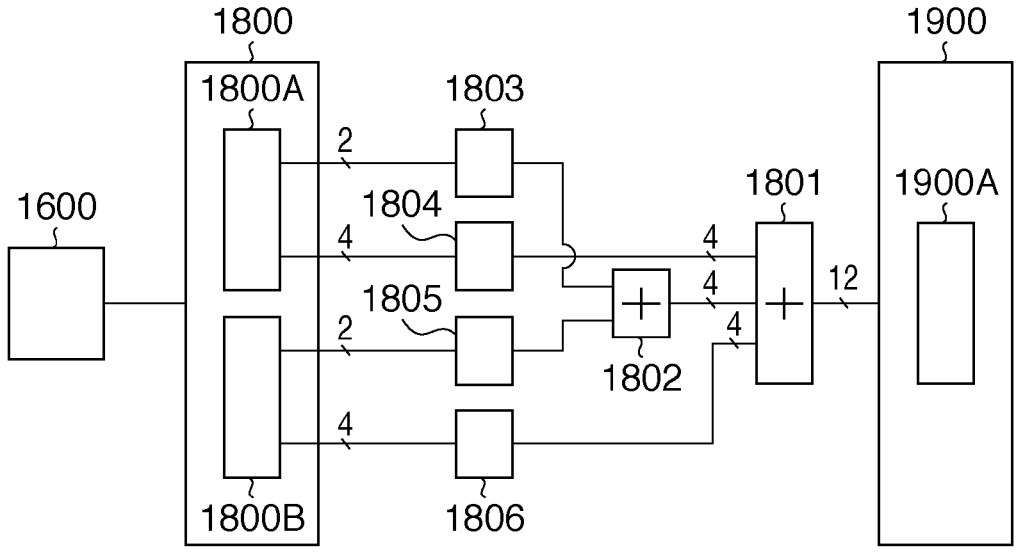
FIGS. 14A and 14B are circuit diagrams for explaining the control circuit of the inkjet printing apparatus.

FIG. 14A is a circuit diagram of the control circuit of an inkjet printing apparatus according to the first embodiment. Processing for print data and block control data will be explained with reference to FIG. 14A. A data generation unit 1800 receives print data buffered in a print buffer 1600, and generates data to be transferred to the printhead. A transfer unit 1900 transfers, to the printhead, data generated by the data generation unit 1800. A gate array 1704 includes the data generation unit 1800 and transfer unit 1900. A DRAM 1703 includes the print buffer.

The data generation unit 1800 generates print data of 4 bits used in the heater array. Although not described in detail, the data generation unit 1800 generates column binary data when data buffered in the print buffer are raster multilevel data. The data generation unit 1800 buffers print data D0 to D3 and block control data B0 and B1 for the heater array L2 among generated data in a buffer 1800A. The data generation unit 1800 also buffers print data D4 to D7 and block control data B0 and B1 for the heater array L3 in a buffer 1800B.

A latch circuit 1803 latches block control data for the heater array L2. A latch circuit 1805 latches block control data for the heater array L3. A latch circuit 1804 latches print data for the heater array L2. A latch circuit 1806 latches print data for the heater array L3. A data coupling unit 1802 couples outputs from the latch circuits 1803 and 1805. A data coupling unit 1801 couples a total of 12 bits: the print data D0 to D3, print data D4 to D7, and two block control data B0 and B1.

The transfer unit 1900 includes a transfer buffer 1900A which buffers data to be transferred to the shift register 1104 in FIG. 1. The transfer buffer 1900A transfers 12-bit data. This arrangement processes data to be transferred to the printhead.

The shift register 1104 in FIG. 1 integrates shift registers for two arrays, each of which holds print data signals of 4 bits corresponding to 16 print elements of one print element array. Thus, the shift register 1104 holds print data signals D0 to D7 of a total of 8 bits. In addition, the shift register 1104 holds block control data B0 and B1 corresponding to respective print element arrays for two arrays (a total of 4 bits). That is, in the element substrate according to the first embodiment, the number of bits of the shift register corresponding to two print element arrays in each of which 16 print elements are arranged is a total of 12 bits. The shift register circuit which is integrated in the element substrate according to the first embodiment and corresponds to print element arrays in which 32 print elements are arranged has the same arrangement as that of a shift register circuit which is integrated in an element substrate and corresponds to a print element array of 32 print elements shown in FIG. 4. The number of data bits held in the shift register circuit shown in FIG. 4 is 10. A comparison between the shift register circuits of the element substrates shown in FIGS. 1 and 4 reveals that the difference between the number of data bits held in the shift register circuit corresponding to two print element arrays in each of which 16 print elements are arranged, and that of data bits held in the shift register circuit corresponding to one print element array in which 32 print elements are arranged is 2 bits. In this manner, the difference between the numbers of data bits held in the respective shift register circuits is reduced. Thus, data can be transferred to each print element efficiently. A smaller difference in the number of bits decreases the data transfer speed difference. It is also possible to make, almost equal to each other, the numbers of bits in shift register circuits arranged for print element arrays formed from different numbers of print elements. If shift register circuits for print element arrays having the same number of print elements are combined into one, the number of input terminals for print data and the like can be decreased to increase the circuit layout efficiency. As a result, the element substrate can be downsized.

Second Embodiment

Figure 2:
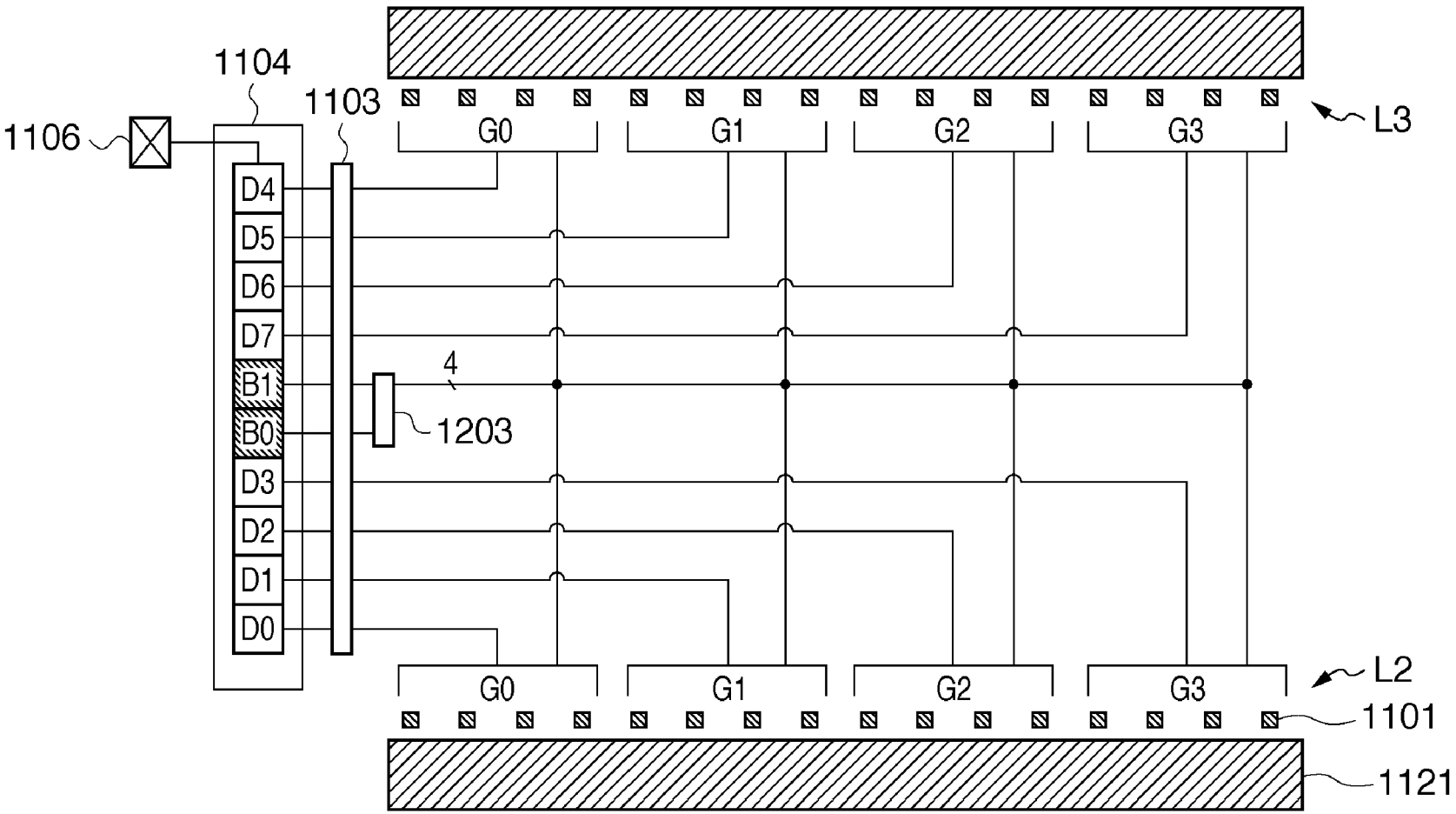
FIG. 2 is a block diagram of a heater array in which heaters are arrayed at low density and a shift register corresponding to the heater array in an element substrate, according to the second embodiment of the present invention.

In the element substrate according to the first embodiment, a shift register circuit corresponding to a print element array formed from a small number (16) of print elements holds block control data corresponding to each of two print element arrays. When the time-divisional counts of two print element arrays are equal to each other, it is also possible for the two print element arrays to use a common block selection signal based on block control data. FIG. 2 is a circuit diagram of a print element array and shift register circuit in an element substrate according to the second embodiment. The element substrate according to the second embodiment has the same arrangement as that of the element substrate according to the first embodiment except for an arrangement shown in FIG. 2. Heater arrays L2 and L3 will be exemplified. A latch circuit 1103 and decoder 1203 are identical to those in the first embodiment, and a description thereof will not be repeated.

In the element substrate of the second embodiment, as shown in FIG. 2, two print element arrays commonly use block control data B0 and B1 held in a shift register circuit corresponding to two arrays each formed from 16 print elements. A shift register 1104 shown in FIG. 2 holds print data D0 to D7 of a total of 8 bits corresponding to two print element arrays, and block control data B0 and B1 of 2 bits commonly used for the print element arrays. In the element substrate according to the second embodiment, the number of bits in the shift register circuit corresponding to two arrays each formed from 16 print elements is 10. In this case, the number of bits in this shift register circuit becomes equal to the number of data bits held in a shift register circuit corresponding to one print element array formed from 32 print elements, as shown in FIG. 4. Since the numbers of bits in the shift register circuits become equal to each other, data can be transferred to each print element more efficiently than in the element substrate of the first embodiment.

Figure 14B:
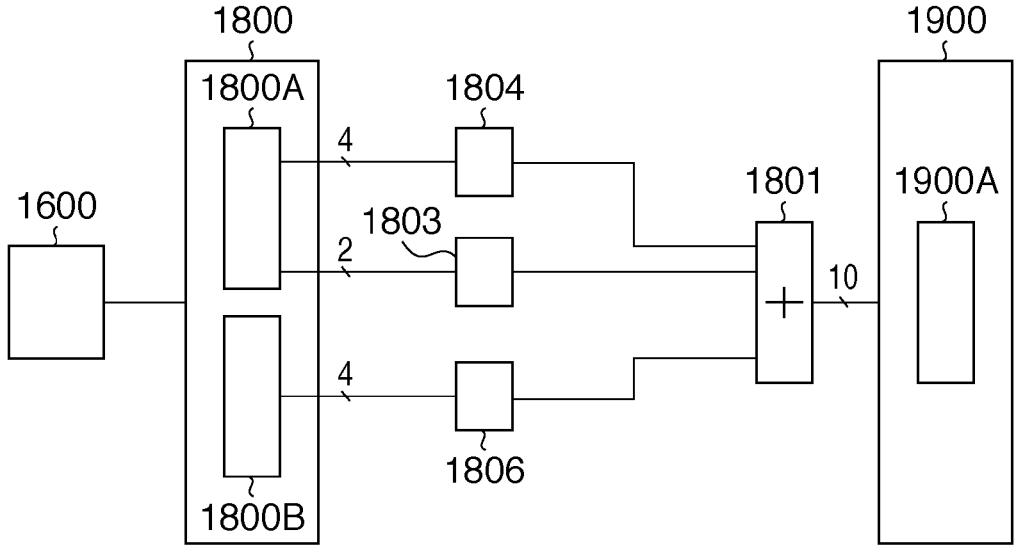

FIG. 14B is a circuit diagram of the control circuit of an inkjet printing apparatus according to the second embodiment. Only a difference from the control circuit of the inkjet printing apparatus according to the first embodiment will be explained. In the second embodiment, common block control data B0 and B1 are used. Hence, a latch circuit 1803 holds block control data B0 and B1 for either heater array (in this case, the heater array L2). A latch circuit 1804 latches print data for the heater array L2. A latch circuit 1806 latches print data for the heater array L3. A data coupling unit 1801 couples outputs from the three latch circuits to hold 10-bit print data. The data coupling unit 1801 outputs the data to a transfer buffer 1900A. The transfer buffer 1900A transfers 12-bit data to the printhead.

In the element substrates described in the first and second embodiments, shift register circuits arranged for two print element arrays formed from the same number of print elements are combined into one. However, the present invention is not limited to this. For example, the present invention is also applicable to an arrangement in which shift register circuits arranged for three or more print element arrays formed from the same number of print elements are combined into one. Also in this case, one shift register circuit has one independent data input line.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-122774, filed May 8, 2008, which is hereby incorporated by reference herein in its entirety.

What is claimed is:

1. A print element substrate comprising:

a first print element array having a plurality of print elements;

a second print element array having a plurality of print elements, provided in parallel to said first print element array; and a first shift register circuit which holds first data for driving the print elements belonging to said first print element array and second data for driving the print elements belonging to said second print element array, wherein the first data and the second data are serially inputted from one terminal, wherein a plurality of first signal lines used for sending the first data from the first shift register circuit to the first print element array in parallel, and a plurality of second signal lines used for sending the second data from the first shift register circuit to the second print element array in parallel are provided in an area between the first print element array and the second print element array.

2. The print element substrate according to claim 1, further comprising:

a first driving circuit which divides the plurality of print elements included in said first print element array;

a second driving circuit which divides the plurality of print elements included in said second print element array; and a decoder which decodes data at a bit position in a first range held in said first shift register circuit to output the data to said first driving circuit, and decodes data at a bit position in a second range to output the data to said second driving circuit.

3. The print element substrate according to claim 1, further comprising:

a first driving circuit which divides the plurality of print elements included in said first print element array;

a second driving circuit which divides the plurality of print elements included in said second print element array; and a decoder which decodes data at a bit position in a predetermined range held in said first shift register circuit to output the data to said first driving circuit and said second driving circuit.

4. A printhead having a print element substrate according to claim 1.

5. A printing apparatus having a carriage to which a printhead according to claim 4 can be attached.

6. The printing apparatus according to claim 5, further comprising a circuit which generates data to be transferred to the printhead.

7. The print element substrate according to claim 1, wherein the plurality of print elements is used for printing by discharging ink, wherein the first print element array is provided near a first ink supply port for supplying ink to the plurality of print elements belonging to said first print element array, and wherein the second print element array is provided near a second ink supply port for supplying ink to the plurality of print elements belonging to said second print element array.

8. The print element substrate according to claim 1, further comprising:

a third print element array having a plurality of print elements, provided in parallel to said first print element array; and a second shift register circuit which holds third data for driving the print elements belonging to said third print element array, wherein the third data is serially inputted to said second shift register circuit from another terminal, and wherein a number of bits in the second shift register circuit is substantially equal to that in the first shift register circuit.

* * * * *